US010661925B2

(12) United States Patent
Warchol et al.

(10) Patent No.: US 10,661,925 B2
(45) Date of Patent: May 26, 2020

(54) FILLING SYSTEM FOR A MACHINE FOR FILLING TRAYS AND A METHOD FOR FILLING TRAYS

(71) Applicant: INTERNATIONAL TOBACCO MACHINERY POLAND SPOLKA Z OGRANICZONA ODPOWIEDZIALNOSCIA, Radom (PL)

(72) Inventors: Marek Warchol, Pionki (PL); Radoslaw Owczarek, Radom (PL)

(73) Assignee: International Tobacco Machinery Poland Sp. z o.o., Radom (PL)

( * ) Notice: Subject to any disclaimer, the term of this patent is extended or adjusted under 35 U.S.C. 154(b) by 347 days.

(21) Appl. No.: 15/011,588

(22) Filed: Jan. 31, 2016

(65) Prior Publication Data

US 2016/0221698 A1 Aug. 4, 2016

(51) Int. Cl.

| | |
|---|---|
| ***B65B 19/04*** | (2006.01) |
| ***A24C 5/354*** | (2006.01) |
| ***B65B 35/42*** | (2006.01) |

(52) U.S. Cl.

CPC ..... *B65B 19/04* (2013.01); *A24C 5/354* (2013.01); *B65B 35/42* (2013.01)

(58) Field of Classification Search

CPC ..... A24C 5/354
USPC ..... 53/473
See application file for complete search history.

(56) References Cited

U.S. PATENT DOCUMENTS

| | | | | |
|---|---|---|---|---|
| 3,320,717 | A * | 5/1967 | Molins | A24C 5/354 53/151 |
| 4,093,075 | A * | 6/1978 | Molins | B65B 19/30 209/535 |
| 4,344,523 | A * | 8/1982 | May | B65G 47/841 198/418.3 |
| 4,487,001 | A | 12/1984 | Tolasch | |
| 4,489,534 | A | 12/1984 | Gomann | |
| 4,667,831 | A * | 5/1987 | Mattei | B65B 19/30 131/907 |
| 5,548,941 | A * | 8/1996 | Portaro | B65B 19/04 198/418.1 |

(Continued)

FOREIGN PATENT DOCUMENTS

DE 19829735 1/2000

*Primary Examiner* — Chelsea E Stinson
(74) *Attorney, Agent, or Firm* — Soody Tronson; STLG Law Firm

(57) ABSTRACT

A filling system for a machine used, in a tobacco industry for filling trays with rod-shaped articles that are dispensed from a dispenser, the filling system comprising a filling unit comprising rotary rollers for facilitating the passing or traversing of the rod-shaped articles from the dispenser to the tray below the filling system and a blocking unit for blocking passing or traversing of the rod-shaped articles from the dispenser to the tray. In an embodiment, the blocking unit may comprise pressing elements movable in a direction of axes of the rotary rollers between a blocked position, in which the pressing elements are located at a first distance, not greater than a length of the rod-shaped articles, from a back wall of the dispenser and an unblocked position, in which the pressing elements are located at a second distance, greater than the length of the rod-shaped articles, from the back wall of the dispenser.

10 Claims, 7 Drawing Sheets

(56) References Cited

U.S. PATENT DOCUMENTS

| | | | | |
|---|---|---|---|---|
| 7,325,382 | B2 * | 2/2008 | Nelson | A24C 5/06 53/148 |
| 8,662,088 | B2 * | 3/2014 | Owczarek | A24C 5/02 131/282 |
| 2013/0284188 | A1 * | 10/2013 | Owczarek | A24C 5/02 131/108 |

* cited by examiner

FILLING SYSTEM FOR A MACHINE FOR FILLING TRAYS AND A METHOD FOR FILLING TRAYS

FIELD OF INVENTION

The present disclosure relates to a filling system for a machine for filling trays with rod-shaped articles and a method for filling trays with rod-shaped articles in a tobacco industry.

BACKGROUND

The tobacco industry involves manufacture of various products, such as cigarettes, cigarillos, cigars and filter rods, which may be generally classified as rod-shaped articles. The "rod-shaped" term relates both to final and intermediate products that undergo further manufacturing processes. The manufactured rod-shaped articles may be transported between consecutive machines of the manufacturing line or stored. The products are often transported between consecutive sites of the manufacturing line, or stored, in parallelepiped-shaped trays having two open walls. These trays are filled utilizing machines for filling trays with rod-shaped articles, so called "tray fillers." A problem in construction of the tray filler is appropriate functioning of the filling system, which may be responsible for distributing a specified amount of rod-shaped articles into consecutively supplied trays and arranging the consecutive layers of articles so that the articles form a honeycomb-like structure. After filling up of every consecutive trays, the filling system may be closed. After the closure, no more articles should move into to the area below the filling system.

There are known various filling systems, for example from the German patent application DE 198 29 735 and US patent documents U.S. Pat. Nos. 4,487,001 and 4,489,534.

Another method for blocking articles in the filling system is disclosed in GB 1 186 348 A publication.

The documents presented above do not provide a solution which would provide an appropriate arrangement of higher layers of a tray, in particular due to, even after closing of the filling system, single articles may still may pass through the filling system.

SUMMARY

In an embodiment, a filling system for a machine used in tobacco industry for filling trays with rod-shaped articles that are dispensed from a dispenser, may comprise: a filling unit comprising rotary rollers for facilitating the passing or traversing of the rod-shaped articles from the dispenser to the tray below the filling system; and a blocking unit for blocking the passing or the traversing of the rod-shaped articles from the dispenser to the tray, characterized in that the blocking unit may comprise pressing elements movable in a direction of axes of the rotary rollers between a blocked position, in which the pressing elements are located at a first distance, not greater than a length of the rod-shaped articles, from a back wall of the dispenser and an unblocked position, in which the pressing elements are located at a second distance, greater than the length of the rod-shaped articles, from the back wall of the dispenser.

In some embodiments a filling system for a machine which may be used in a tobacco industry for filling trays, may comprise: a filling unit comprising rotary rollers for facilitating the passing or the traversing of the rod-shaped articles from the dispenser to the tray below the filling system; and a blocking unit for blocking the passing or traversing of the rod-shaped articles from the dispenser to the tray, characterized in that the blocking unit may comprise pressing elements movable in a direction of axes of the rotary rollers between a blocked position, in which the pressing elements are configured to press the rod-shaped articles towards a back wall of the dispenser and an unblocked position, in which the pressing elements do not block the pass of the rod-shaped articles from the dispenser to the tray.

In an embodiment, the pressing elements may be mounted to at least one support, which is deformable in the direction of the axes of the rotary rollers.

In an embodiment, the deformable support may be an elastic bar.

In an embodiment, the deformable support may be a spring.

In an embodiment, pressing elements may be mounted on a different deformable support, wherein a plurality of deformable supports are mounted on a mounting bar, which is displaceable in the direction of the axes of the rotary rollers.

In an embodiment, a plurality of the pressing elements may be mounted on a common deformable support.

In an embodiment, the pressing elements may be located between the rotary rollers.

In an embodiment, the pressing elements may be located at the level of the rotary rollers.

In an embodiment, the pressing elements may be located above the rotary rollers.

In an embodiment, the pressing elements may be located below the rotary rollers.

In an embodiment, a method for filling trays with rod-shaped articles dispensed from a dispenser in a machine used in a tobacco industry, may comprise: delivering an empty tray to the dispenser; dispensing from the dispenser to the tray, utilizing rotary rollers of a filling unit, the rod-shaped articles until the tray is filled up to a desired level, wherein the rotary rollers of the filling unit are located in a filling plane parallel to a bottom of the tray; blocking the dispensing of the rod-shaped articles to the tray in a blocking plane parallel to the filling plane; wherein the dispensing of the rod-shaped articles to the tray is blocked by pressing the rod-shaped articles towards a back wall of the dispenser in a direction parallel to the axes of the rotary rollers.

In an embodiment, the dispensing of the rod-shaped articles may be blocked in the blocking plane coinciding with the filling plane.

In an embodiment, the dispensing of the rod-shaped articles may be blocked in the blocking plane located above the filling plane.

In an embodiment, the dispensing of rod-shaped articles may be blocked in the blocking plane located below the filling plane.

In some embodiments due to locating the pressing elements at the same level as the rotary rollers, upper layers, such as the highest layer, may be limited from above with the plane which may prevent additional articles to be laid on, for example, the highest layer it, thereby solving a problem present in the prior art systems.

An apparatus that accords with embodiments described herein, may provide that the articles, which are blocked in the filling system, are not blocked in the inclined position with respect to the rollers of the filling unit, do not protrude from the bottom side of unit and are not prone to destruction during the feeding of the consecutive empty tray for filling.

It should be understood that the aforementioned implementations are merely example implementations, and that claimed subject matter is not necessarily limited to any particular aspect of these example implementations.

BRIEF DESCRIPTION OF DRAWINGS

Non-limiting and non-exhaustive features of the present invention are described with reference to the following figures, wherein like reference numerals refer to like parts throughout the various figures.

The system and method are presented by way of example embodiments in a drawing, wherein.

DETAILED DESCRIPTION

Figure 1:
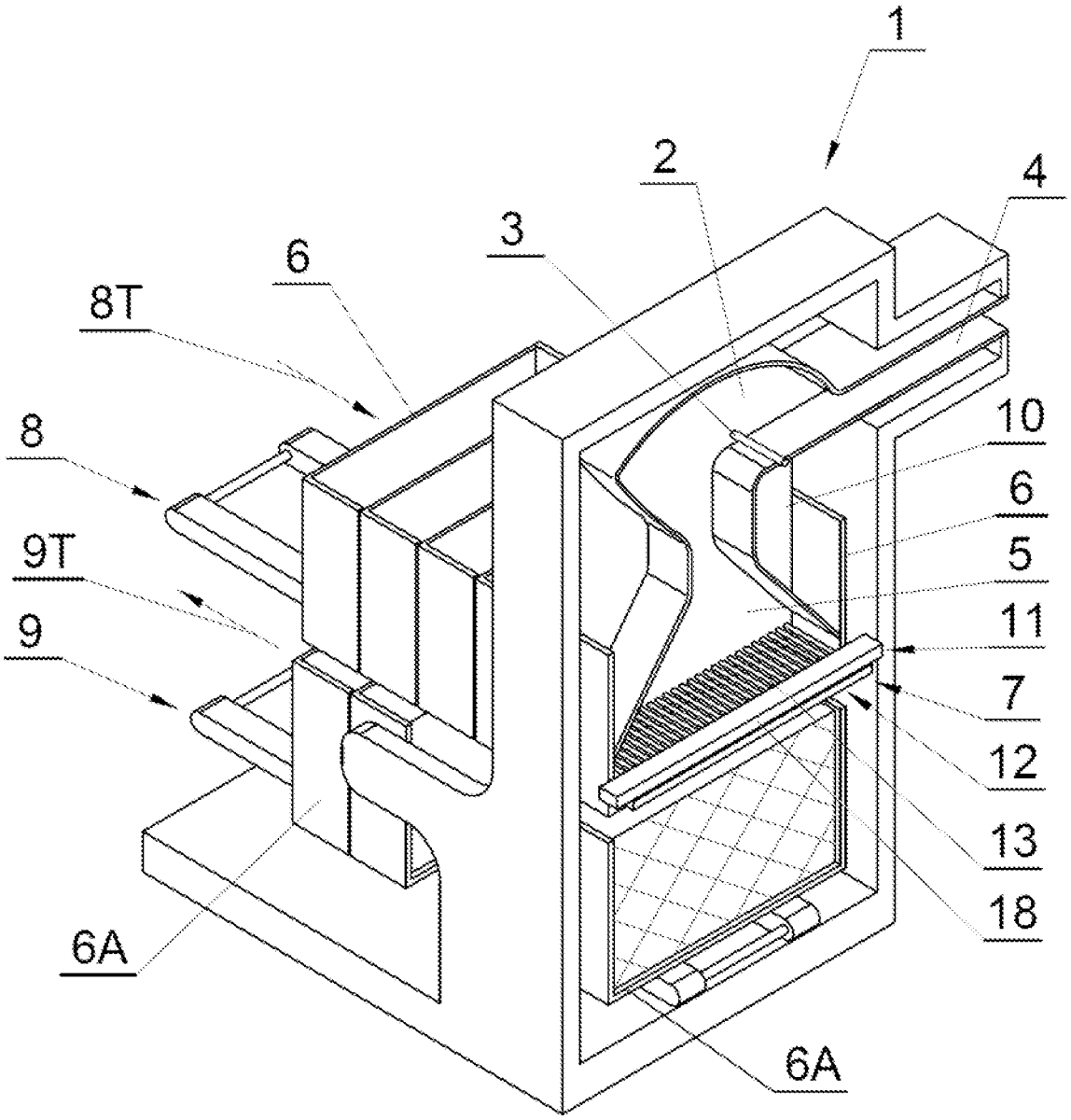
FIG. 1 shows a tray filler according to an embodiment.
Figure 2:
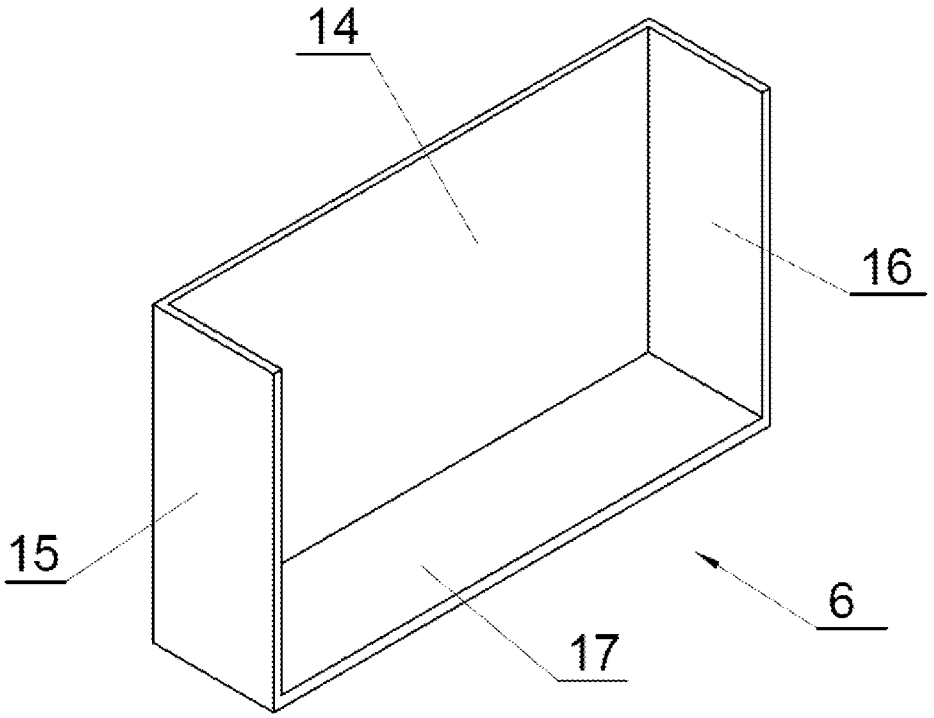
FIG. 2 shows a tray for rod-shaped articles according to an embodiment.
Figure 3:
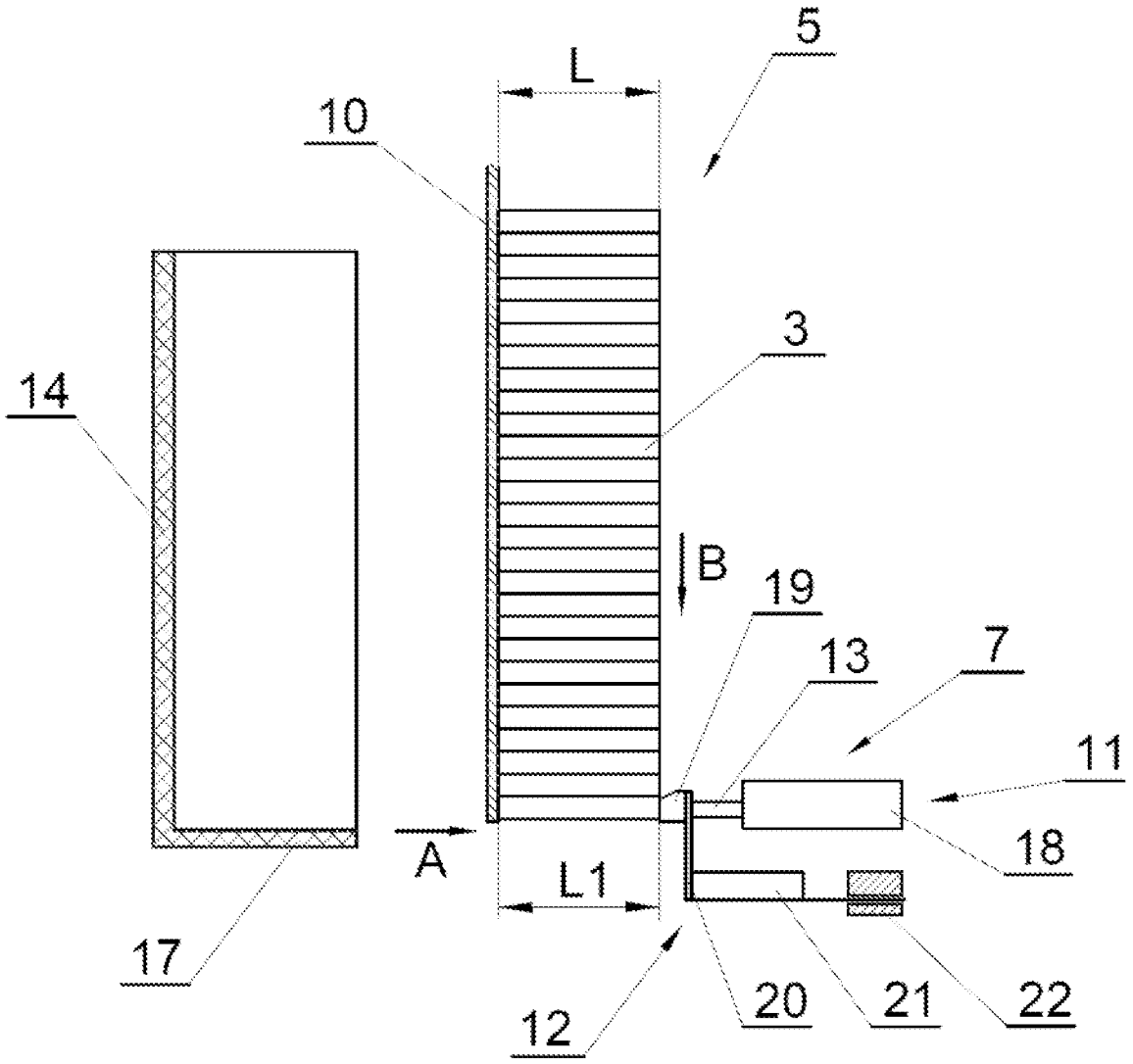
FIG. 3 shows a filling system, with a blocking unit having pressing elements mounted on supports, before the start of the filling of the tray, before feeding of an empty tray, wherein the tray is shown in a cross-section according to an embodiment.
Figure 6A:
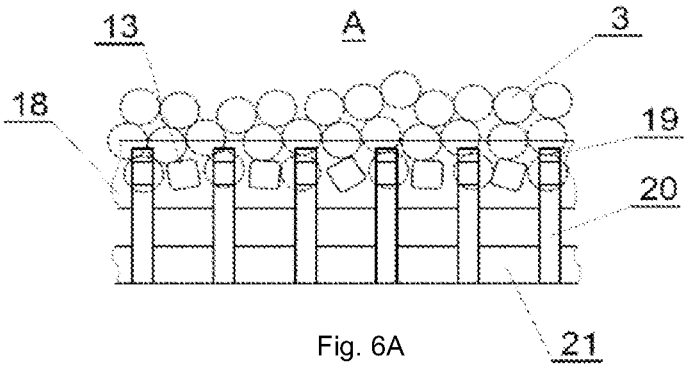
FIGS. 6A-6C shows the filling system in a blocked position in a view from the side of the hopper of the rod-shaped articles according to various embodiments.
Figure 7:
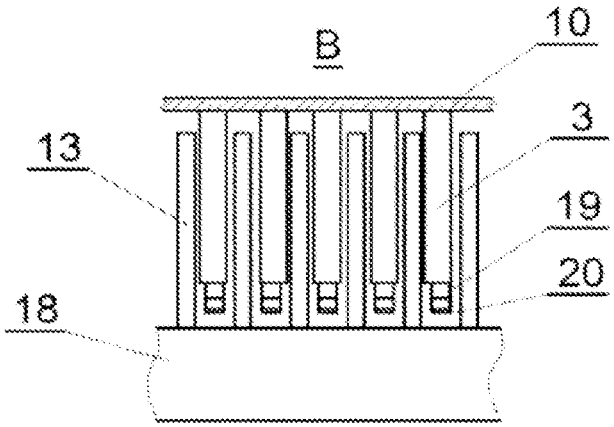
FIG. 7 shows the filling system in the blocked position in a top view according to an embodiment.

FIG. 1 shows a tray filler 1 adapted for filling a tray 6, which is shown in FIG. 2. The filler 1 is equipped with a hopper 2 which is filled with rod-shaped articles, such as cigarettes, cigarillos, cigars or filter rods, during the time of the operation of the tray filler 1. The rod-shaped articles 3 are fed to the hopper 2 through a supply channel 4, wherein the Supply channel 4 can be equipped with belt conveyors for transporting the articles 3 to the hopper 2. The rod-shaped articles 3 pass under gravity from the hopper 2 to a dispenser 5, which is limited, at its bottom side, by elements of a filling system 7. Empty trays 6 are fed to the filling system 7 by a transporter 8 of the empty trays 6 in a direction 8T. During the time of filling, the trays 6 are lowered down, a filled tray 6A is put on a transporter 9 of full trays, which transports it in a direction 9T to a system (not shown in the drawing) for receiving the full trays 6A, located behind the filler 1. The empty tray 6 is put in the filling position, such that a back wall 14 of the tray 6 is adjacent to the wall 10 that constitutes the back wall of the hopper 2 and of the dispenser 5, whereas side walls 15 and 16 of the trays 6 encompasses a back wall 10, and a bottom 17 of the trays 6 is placed below the filling system 7. The filling system 7 comprises a filling unit 11 and a blocking unit 12, which are shown in details in FIG. 3. The filling unit 11 comprises a plurality of rollers 13 positioned in parallel to each other and mounted pivotally in a housing 18. The housing 18 has a form of horizontally extending bar, basically being parallel to the back side 10. As shown in FIG. 6A (view in the direction A as shown in FIG. 3) and FIG. 7 (view in direction B shown in FIG. 3), the rollers 13 are spaced at a distance such that the rod-shaped articles 3 can pass between them. The rollers 13 may have a circular or a polygonal cross-section. Between the rollers 13 there are located pressing elements 19 of the blocking unit 12.

Figure 4:
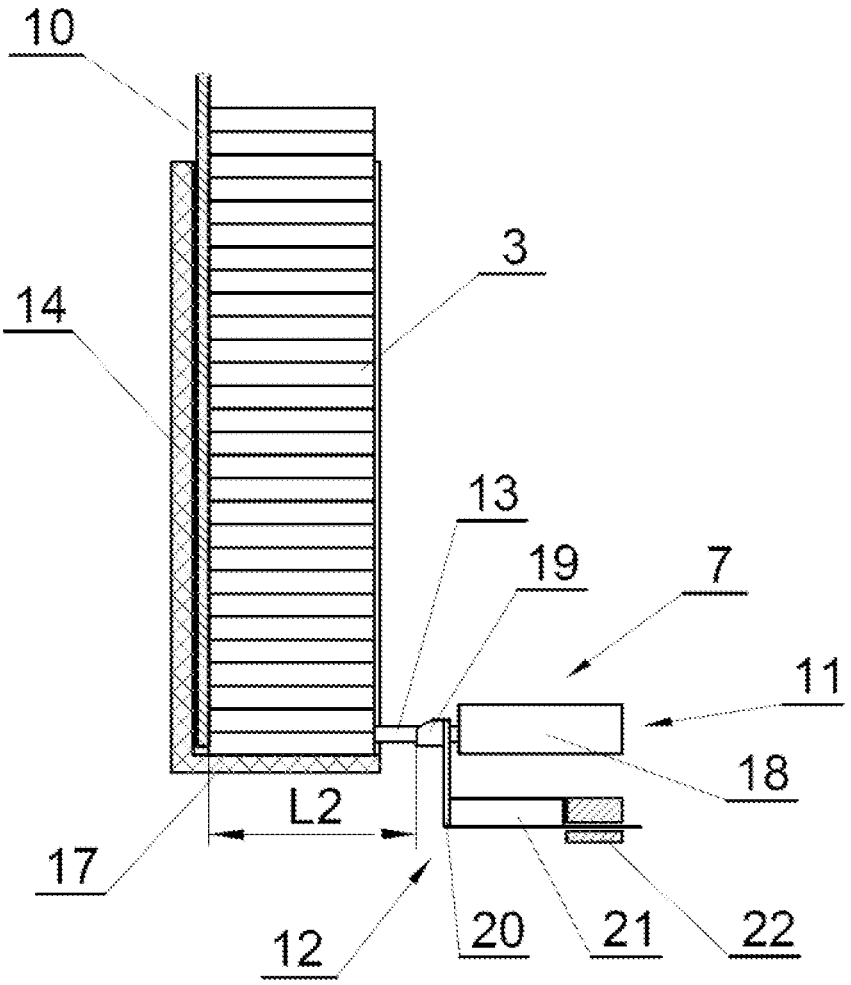
FIG. 4 shows the filling system after providing the empty tray and after beginning of the filling of the tray, wherein the tray is shown in a cross-section according to an embodiment, FIG. 5 show the filling system after the filling of the tray is finished, wherein the tray is shown in a cross-section according to an embodiment.
Figure 5:
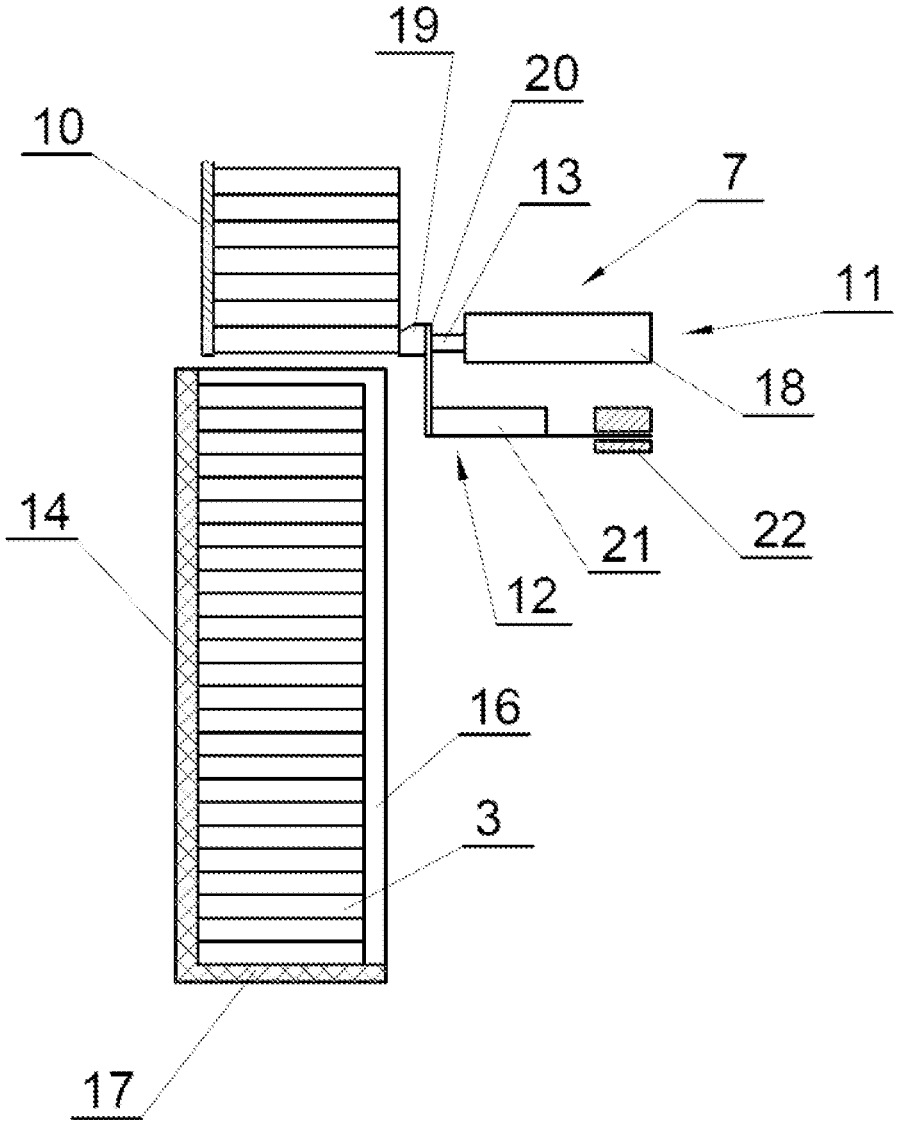

The pressing elements 19 can be moved between a blocked position and an unblocked position in the direction of the axes of the rotary rollers 13. In the blocked position, as shown in FIGS. 3 and 5, the pressing elements 19 are configured to press the rod-shaped articles 3 towards the back wall 10 of the dispenser 5. In other words, in the blocked position, the distance L1 between the pressing elements 19 and the back wall 10 of the dispenser 5 is not greater than the length L of the rod-shaped articles 3. In the unblocked position, as shown in FIG. 4, the distance L2 between the pressing elements 19 and the back wall 10 of the dispenser 5 is greater than the length L of the rod-shaped articles 3, so that the pressing elements 19 do not block the passing or the traversing of the rod-shaped articles 3 from the dispenser 5 to the tray.

The pressing elements 19 can be mounted on a mounting bar 21 which is slidably mounted to a slider 22 and displaceable in a direction parallel to the axes of the rollers 13, for example utilizing a typical pneumatic cylinder, electromagnet or another drive performing linear motion (not shown in the drawing).

The pressing elements 19 can be mounted on supports 20 that are deformable in the direction of the axes of the rotary rollers 13. Consequently, the pressing elements 19 may be displaced towards the back wall 10 of the dispenser 5 at the distance L1 slightly smaller than the length L of the rod-shaped articles 3, causing a slight squeezing of the rod-shaped articles 3. The stiffness of the deformable supports 20 of the pressing elements 19 should be selected such that the rod-shaped articles 3 are not excessively squeezed, what could cause their damage. The pressing force of the pressing elements 19 should be selected such that in the blocked position it is greater than the weight of the rod-shaped articles 3, to prevent them from falling down. Use of the deformable supports makes the operation of the filling system resistant to differences in length of the rod-shaped articles 3, due to manufacturing inaccuracies. For example, the blocking unit 12 may be configured such that it can be displaced to the distance L1 smaller by 2% than the nominal length L of the rod-shaped articles 3, wherein the deformable supports 20 may be able to deform by a distance equal to at least 2% of the nominal length L, not to cause excessive squeezing of the rod-shaped articles 3, which allows to block effectively the rod-shaped articles 3 having the length not smaller than 98% of the nominal length.

In particular, the pressing elements 19 may be mounted to the mounting bar 21 on elastic bars 20, which can be made of spring steel or of elastic plastic and may be mounted in an any way on the mounting bar 21.

In the presented embodiment, the pressing elements 19 are mounted on a corresponding separate support. In alternative embodiments, all pressing elements can be mounted on a common resilient support.

Figure 6B:
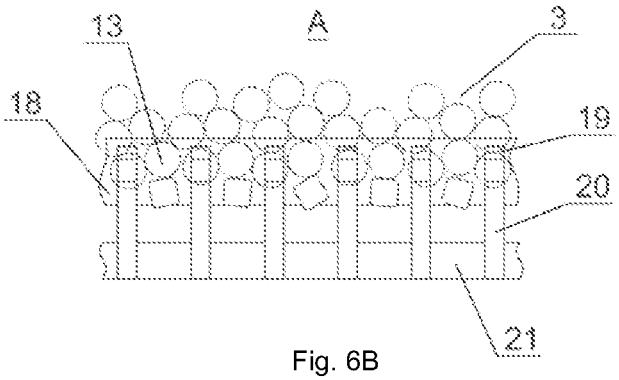
Figure 6C:
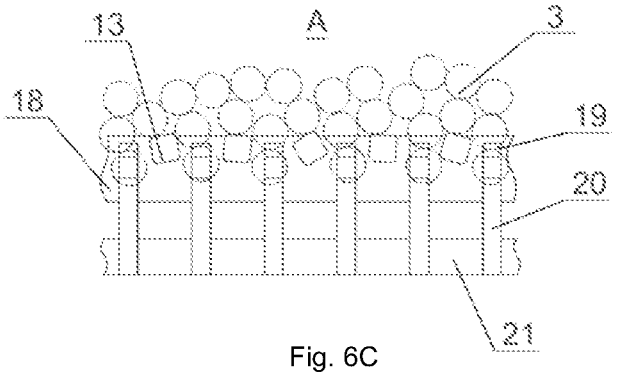

FIG. 3 shows the filling system 7 in the blocked position, i.e. in a position for blocking the passing or traversing of the rod-shaped articles through the system. The pressing elements 19 are moved towards the back wall 10 of the dispenser 5 at the distance L1 not greater than the length L of the rod-shaped articles 3. This situation occurs after filling one tray 6, while the full tray 6A is put on the transporter 9 of full trays, and a subsequent empty tray 6 is delivered to the filling position. The rollers 13 of the filling unit 11 do not rotate, whereas the rod-shaped articles 3 located at the level of the rollers 13 are pressed towards the back wall 10 of the dispenser 5, by the pressing elements 19, as shown on FIG. 6A in a view A in the direction parallel to the axes of the rollers 13 and in FIG. 7 in a top view B of the filling unit 11. In the FIG. 7, only the rod-shaped articles 3 blocked by the pressing elements 19 are shown. As shown in FIG. 6A, the rollers 13 and the pressing elements 19 are situated on one level. In other words, the filling plane, in which the filling unit rotary rollers 13 are placed, and which is parallel to the bottom of the tray, coincides with the blocking plane in which the pressing elements 19 are located. In other example embodiments, the pressing elements 19 may be also located below the rollers 13, such as in FIG. 6C, as well as above rollers 13, such as in FIG. 6B. In other words, the blocking plane may be located below or above the filling plane. The pressing elements 19 should be located between the rollers 13, so that in the blocked position, they prevent the passing or the traversing of the rod-shaped articles between the rollers 13. Independently of the mutual placement of the pressing elements 19 and the rollers 13, the rollers 13 of the filling unit 11, together with the rod-shaped articles 3 blocked by the blocking unit 12, constitute the bottom wall of the distributor 5 and effectively prevent the rod-shaped articles 3 from or traversing to the space below the dispenser, so that they limit the possibility of dispensing additional articles to the highest layer of articles inside the tray.

After supplying the tray 6 in the position shown in FIG. 4, if the back wall 14 of the tray 6 is moved to the back wall 10 of the dispenser 5, the pressing elements 19 are retracted, i.e. moved to the unblocked position, in which they are moved away from the back wall 10 of the dispenser 5 by the distance L2 greater than length L of the rod-shaped articles 3. Therefore, the pressing elements 19 are moved away from the rod-shaped articles 3. Rollers 13 are induced into rotary motion and the filling of the tray 6 begins. After the tray 6 is filled with the rod-shaped articles 3, the pressing elements 19 are displaced towards the direction of the rod-shaped articles 3, to press the rod-shaped articles towards the back wall 10 of the dispenser 5, as shown in FIG. 5 and in the B view in FIG. 7. The full tray 6A is put on the full trays transporter 9.

Figure 8:
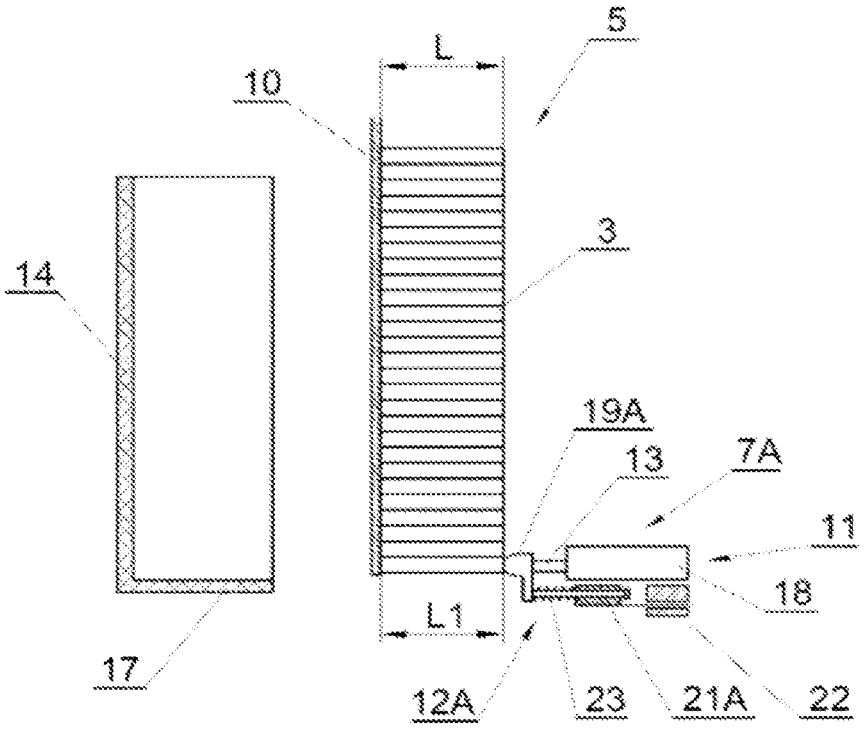
FIG. 8 shows the filling system with a blocking unit having pressing elements mounted on springs, before the beginning of the filling of the tray, before the feeding of an empty tray, wherein the tray is shown in a cross-section according to an embodiment.

FIG. 8 shows an alternative construction of the blocking unit 12A, with the filling system 7A in the configuration equivalent to that of FIG. 3. The pressing element 19A of the blocking unit 12A is slidably mounted on the mounting bar 21A, and the force necessary for blocking of the rod-shaped articles 3 is exerted by the spring 23, which may have a form of a coil spring or another known spring.

In the presented embodiment, the tray filler 1 is configured to fill the tray 6, which has a form of a single compartment tray. There are also multi-compartment trays, comprising a plurality of vertically extending compartments, open from the above and from the front and arranged side by side, whereas tray fillers adapted for such trays are known. The blocking unit as described herein may also be applied to multi-compartment fillers, after appropriate adapting it for multiple compartments, for example by application of separate blocking unit for the compartments or by application of common blocking unit for all compartments, without pressing elements located in the place of walls between the compartments.

What is claimed is:

1. A filling system for a machine used in a tobacco industry, the filling system comprising:

a plurality of rotary rollers to discharge rod-shaped articles having an axis parallel to an axis of the rotary rollers, from a dispenser to a tray, the tray disposed below the dispenser; each adjacent rotary rollers spaced apart to permit the rod-shaped articles to drop vertically between the adjacent rotary rollers;

a blocking unit to block conveying of the rod-shaped articles from the dispenser to the tray, the blocking unit comprising pressing elements located between the rotary rollers and movable in a direction of axes of the rotary rollers and in the same axis as the axis of the rod-shaped articles, between:

a blocked position, in which the pressing elements are located at a first distance, not greater than a length of the rod-shaped articles, from a back wall of the dispenser so as to press the rod-shaped elements against the back wall of the dispenser to block the dispensing of the rod-shaped articles from the dispenser to the tray; and an unblocked position, in which the pressing elements are located at a second distance, greater than the length of the rod-shaped articles, from the back wall of the dispenser.

2. The filling system according to claim 1, wherein the pressing elements are mounted to at least one support, which is deformable in the direction of the axes of the rotary rollers.

3. The filling system according to claim 2, wherein the deformable support comprises an elastic bar.

4. The filling system according to claim 2, wherein the deformable support comprises a spring.

5. The filling system according to claim 2, wherein pressing elements are mounted on a corresponding deformable support, wherein a plurality of deformable supports is mounted on a mounting bar, which is displaceable in the direction of the axes of the rotary rollers.

6. The filling system according to claim 5, wherein a plurality of the pressing
elements is mounted on a common deformable support.

7. The filling system according to claim 1, wherein the pressing elements press the front faces of ends of the rod-shaped articles.

8. The filling system according to claim 1, wherein the pressing elements are located at the level of the rotary rollers.

9. The filling system according to claim 1, wherein the pressing elements are located above the rotary rollers.

10. The filling system according to claim 1, wherein the pressing elements are located below the rotary rollers.

* * * * *